US010919070B2

(12) United States Patent
Saito et al.

(10) Patent No.: US 10,919,070 B2
(45) Date of Patent: Feb. 16, 2021

(54) COATING DEVICE WITH ROLLER AND DOCTOR BLADE

(71) Applicant: MITSUBISHI HEAVY INDUSTRIES, LTD., Tokyo (JP)

(72) Inventors: Hiroyuki Saito, Tokyo (JP); Takashi Shibutani, Tokyo (JP); Kazuto Nakamura, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 59 days.

(21) Appl. No.: 16/078,433

(22) PCT Filed: Feb. 3, 2017

(86) PCT No.: PCT/JP2017/004044
§ 371 (c)(1),
(2) Date: Aug. 21, 2018

(87) PCT Pub. No.: WO2017/154433
PCT Pub. Date: Sep. 14, 2017

(65) Prior Publication Data

US 2019/0047012 A1 Feb. 14, 2019

(30) Foreign Application Priority Data

Mar. 10, 2016 (JP) ..... 2016-047011

(51) Int. Cl.
*B05C 11/10* (2006.01)
*B05C 1/08* (2006.01)
(Continued)

(52) U.S. Cl.
CPC ..... *B05C 1/02* (2013.01); *B05C 1/0813* (2013.01); *B05C 11/10* (2013.01);
(Continued)

(58) Field of Classification Search
CPC ..... B05C 1/0813; B05C 1/083; B05C 1/0817; B05C 1/165; B05D 1/28
(Continued)

(56) References Cited

U.S. PATENT DOCUMENTS 2,787,244 A * 4/1957 Hickin ..... B05C 1/165 118/259
3,641,978 A * 2/1972 Hathorn ..... D21H 5/0015 118/412
(Continued)

FOREIGN PATENT DOCUMENTS

EP 0769368 A2 4/1997
EP 2078595 A1 7/2009
(Continued)

OTHER PUBLICATIONS

PCT, "International Search Report for International Application No. PCT/JP2017/004044" dated May 16, 2017.
(Continued)

*Primary Examiner* — Karl Kurple
(74) *Attorney, Agent, or Firm* — Manabu Kanesaka; Kenneth M. Berner; Benjamin Hauptman

(57) ABSTRACT

The objective of the present invention is to provide a coating device capable of stably coating a coating agent onto a member to be coated, while preventing the supply of excess coating agent. A coating device is provided with: a roller which rotates in one direction; a tank in which an opening is formed facing the roller and which supplies a coating agent via the opening; a doctor blade provided at the side of the opening on the rotation exit side of the roller; and a doctor blade provided at the side of the opening on the rotation entry side of the roller; wherein a gap formed between the doctor blade and the roller is larger than a gap formed between the doctor blade and the roller.

6 Claims, 15 Drawing Sheets

(51) Int. Cl.
*B05D 1/28* (2006.01)
*B05C 1/02* (2006.01)
*B05C 11/02* (2006.01)

(52) U.S. Cl.
CPC ..... *B05C 11/1039* (2013.01); *B05D 1/28* (2013.01); *B05C 1/0808* (2013.01); *B05C 11/021* (2013.01); *B05C 11/1023* (2013.01)

(58) Field of Classification Search
USPC ..... 118/261
See application file for complete search history.

(56) References Cited

U.S. PATENT DOCUMENTS 3,991,708 A * 11/1976 Huebschmann ..... B05C 1/0813 118/44
4,139,613 A * 2/1979 Hefele ..... A41D 27/06 427/197
4,141,313 A * 2/1979 Hefele ..... A41D 27/06 118/212
4,232,628 A * 11/1980 Shelffo ..... G03G 15/0806 399/284
4,440,105 A 4/1984 Jeltema
4,677,002 A 6/1987 Poterala
4,836,134 A 6/1989 Jagenberg Altiengesellschaft
4,871,593 A * 10/1989 McIntyre ..... B05C 1/0813 427/207.1
5,628,868 A 5/1997 Marschke et al.
6,554,900 B1 * 4/2003 Aydin ..... B05C 1/0813 118/211
7,520,934 B2 * 4/2009 Nojo ..... B05C 1/0817 118/212
2001/0017104 A1 * 8/2001 Choi ..... B05C 1/083 118/224
2006/0231021 A1 10/2006 Friske et al.
2009/0232997 A1 9/2009 Kusunoki
2018/0056321 A1 * 3/2018 Jansen ..... B05C 1/0847

FOREIGN PATENT DOCUMENTS

IT MO20100290 A1 4/2012
JP S59-225767 A 12/1984
JP S61-64362 U 5/1986
JP S63-256161 A 10/1988
JP H10-137648 A 5/1998
JP 2004-337719 A 12/2004
JP 2005-254095 A 9/2005
JP 2012-24677 A 2/2012

OTHER PUBLICATIONS

Europe Patent Office, "Search Report for European Patent Application No. 17762778.3," dated Apr. 18, 2019.

* cited by examiner

COATING DEVICE WITH ROLLER AND DOCTOR BLADE

RELATED APPLICATIONS

The present application is National Phase of International Application No. PCT/JP2017/004044 filed Feb. 3, 2017, and claims priority from Japanese Application No. 2016-047011, filed Mar. 10, 2016, the disclosure of which is hereby incorporated by reference herein in its entirety.

TECHNICAL FIELD

The present invention relates to a coating device.

BACKGROUND ART

A coating method of applying a coating agent such as a sealing material to a member surface by hand using a roller is performed as follows. First, a coating agent is spread on a pallet, the coating agent on the pallet is evenly applied to a roller, and thereafter, the coating is performed to the member surface. If the coating agent attached to the roller becomes thin as a result of application to the member surface, a coating agent is attached to the roller on the pallet. The coating operation is performed by repeating the above-described operations.

In the case of automating the coating operation using a roller by using a device such as a robot which performs a relative feed between the roller and a coating target, a configuration may be considered in which a container storing the coating agent is disposed to be adjacent to the roller, and the coating agent is supplied to the roller. According to this configuration, a step of attaching the coating agent to the roller on the pallet can be omitted.

The following PTL 1 discloses a technology which includes a coating chamber opened toward a roller and in which a coating material is supplied to a strip (a member covered with the coating material) from the coating chamber. An overflow gap is provided on a strip entry side of the coating chamber, and a strip running side is closed by a metering mechanism.

CITATION LIST

Patent Literature

[PTL 1] Japanese Unexamined Patent Application Publication No. 63-256161

SUMMARY OF INVENTION

Technical Problem

In a case where a coating operation is automatized, a roller performs a relative feed on a coating target and the roller is synchronously rotated with respect to the relative feed, and thus, the coating agent on the roller is transferred to the coating target. If an amount of the coating agent not applied to the member surface increases according to a rotation of the roller, the coating agent is accumulated in or is attached to an area other than an application surface of the roller. As a result, the coating agent which is accumulated in or adhered to an area other than the application surface of the roller falls down, which may cause a problem that an area, equipment other than the surface of the coating target is contaminated. In order to avoid the above-described problem, it is necessary to clean the roller or exchange the roller itself even when the roller is used for a short period of time.

A coating target is not limited to a case where the coating target is a uniform and flat surface. That is, the coating target may be tilted in a pitch direction or a roll direction with respect to a traveling direction of the roller or may have a step or unevenness. In a case where the coating operation is automatized, it is necessary to previously set a route through which the roller passes considering the tilt, the step, the unevenness of the coating target so that the roller can travel smoothly.

Respective components such as aircraft parts are roughly similar to each other in shape. However, in a case where coating is applied to various kinds of parts slightly inclined, stepped or uneven, a route of the roller needs to be set for each part, and thus, time and effort are required for programming.

In addition, when a rotational friction of the roller is large, the roller slips on a member surface, the roller does not synchronously rotate with respect to the relative feed, and a portion where the coating is not performed may be generated. A part supporting a shaft of the roller causes stick slip so that the roller does not synchronously rotate with respect to the relative feed, and the coating agent is applied to the member surface in a strip fashion, and thus, there is a problem that a thickness is uneven.

The roller may apply the coating agent, several times, to the coating agent applied to the coating target with a constant thickness, that is, over-coating may be performed to increase a thickness of the coating agent so as to achieve a required thickness of the coating agent. In this case, a friction force at an interface between the coating agent and the roller is low, and thus, the roller does not rotate (or the roller does not synchronously rotate with respect to translation of the roller) due to the stick slip, and as a result, the coating agent is not transferred, and there is a problem that a predetermined thickness of the coating agent cannot be realized.

The present invention is made in consideration of the above-described circumstances, and an object thereof is to provide a coating device capable of stably applying a coating agent to a coating target while preventing a supply of an excess coating agent.

Solution to Problem

According to a first aspect of the present invention, there is provided a coating device including: a roller which is rotated in one direction; a supply system which includes an opening formed with respect to the roller and supplies a coating agent via the opening; a first doctor blade which is provided at the side of the opening on a rotation exit side of the roller; and a second doctor blade which is provided at the side of the opening on a rotation entry side of the roller, in which a gap formed between the second doctor blade and the roller is larger than a gap formed between the first doctor blade and the roller.

According to this configuration, a rotation direction of the roller is one direction, and the gap between the second doctor blade provided on the rotation entry side of the roller and the roller can be largely set while an excess coating agent is prevented from being supplied by the first doctor blade provided on the rotation exit side of the roller. Accordingly, it is possible to prevent the coating agent from being accumulated in the outside of the roller.

In the above-described coating device, the second doctor blade may be provided on a front side in a traveling direction of the roller and vertically of above the roller and the second doctor blade may be installed at a position higher than that of the first doctor blade.

According to this configuration, an outflow limitation of the coating agent which tries to flow out from the gap between the second doctor blade provided on the rotation entry side of the roller and the roller further increases, and thus, the coating agent does not easily leak from the gap.

In the above-described coating device, the coating device may further include two shields which are provided on both end portions in an axial direction of the roller, and an opening width on the rotation entry side of the roller formed between the two shields may be wider than an opening width on the rotation exit side of the roller formed between the two shields.

According to this configuration, the coating agent is not easily accumulated in both end portions in the axial direction of the roller on the rotation entry side of the roller in the supply system.

According to a second aspect of the present invention, there is provided a coating device including: a roller which is rotated in one direction; and a support which is provided in the roller and is configured to tilt the roller in at least one of a pitch direction and a roll direction with respect to a relative traveling direction between the roller and a coating target.

According the above-described configuration, the roller is tilted in at least one of the pitch direction and the roll direction with respect to the relative traveling direction between the roller and the coating target, and thus, even in case where the coating target has an inclined surface or a threaded surface, it is possible to smoothly perform the application of the coating agent.

According to a third aspect of the present invention, there is provided a coating device including: a roller which is rotated in one direction; a supply system which includes an opening formed with respect to the roller and supplies a coating agent via the opening; and bearing members which are provided on both end sides of the roller and rotatably support the roller.

According to the above-described configuration, unlike a case where the rotation support of the roller is performed by a through rod installed to pass through the axis of the roller, when the coating agent is applied, the rotation of the roller is not easily stopped, and the roller does not easily generate the stick slip.

According to a fourth aspect of the present invention, there is provided a coating device including: a roller which is rotated in one direction; a supply system which includes an opening formed with respect to the roller and supplies a coating agent via the opening; a first friction member which is provided in a traveling direction of the roller on a work table side to which the coating agent is supplied; and a second friction member which is provided in a circumferential direction of the roller and comes in to contact with the first friction member.

According to the above described configuration, during the application of the coating agent, when the roller advances in the traveling direction, the second friction member installed on the roller and the first friction member installed on the work table come into contact with each other, and thus, the roller is reliably rotated.

According to a fifth aspect of the present invention, there is provided a coating device including: a roller which is rotated in one direction; a supply system which includes an opening formed with respect to the roller and supplies a coating agent via the opening; a rotation drive portion which rotationally drives the roller; and a controller which synchronizes a speed of the roller in a traveling direction and a rotation speed of the roller.

According to the above-described configuration, it is possible to rotate the roller at a predetermined speed synchronously with the speed in the traveling direction of the roller, and the coating agent can be uniformly applied to the surface of the coating target.

According to a sixth aspect of the present invention, there is provided a coating device including: a roller which is rotated in one direction; a supply system which includes an opening formed with respect to the roller and supplies a coating agent via the opening; and an adjustment unit which applies a friction force against a rotation of the roller and adjusts the friction force to be applied.

According to the above-described configuration, a rotational friction force generated in the roller can be adjusted by using the adjustment unit. For example, the rotational friction force generated in the roller increases to be higher than the friction force generated between the application target surface and the roller, and thus, the roller is not easily rotated. As a result, a thickness of the coating agent applied by once application can be thinner than a predetermined thickness.

According to the present invention, it is possible to stably apply the coating agent to the coating target while preventing a supply of an excess coating agent.

DESCRIPTION OF EMBODIMENTS

First Embodiment

Hereinafter, a coating device according to a first embodiment of the present invention will be described.

Figure 1:
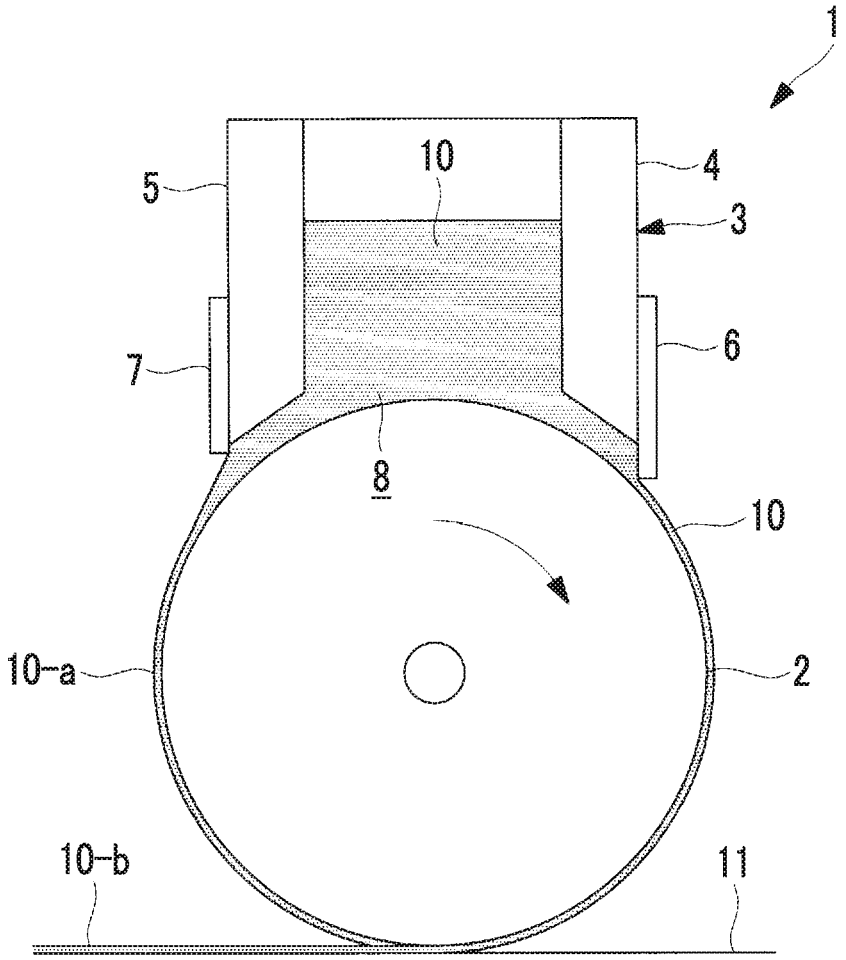
FIG. 1 is a longitudinal sectional view showing a coating device according to a first embodiment of the present invention.

For example, as shown in FIG. 1, a coating device 1 is used when a coating agent 10 such as a sealing material (sealant) is applied to a surface of a coating target 11 using a roller 2. For example, the coating target 11 is an aircraft part and is a stringer, a shear tie. In the case of the stringer or the shear tie, the sealing material is applied to a surface which is spline-connected. Alternatively, the coating target 11 is a plurality of panels configuring a skin of an aircraft part, and when two panels are overlapped and joined to each other, the sealing material is applied to the overlapping part.

For example, the coating device 1 according to the present embodiment is suitable for applying a material having a high viscosity. For example, in the sealing material applied to the aircraft part, the viscosity is from 50 Pa·s to 2500 Pa·s. The sealing material having this viscosity corresponds to a material having an intermediate viscosity or a high viscosity of 10 Pa·s or more within which a discharge control or spreading of the sealing material is difficult.

Figure 17:
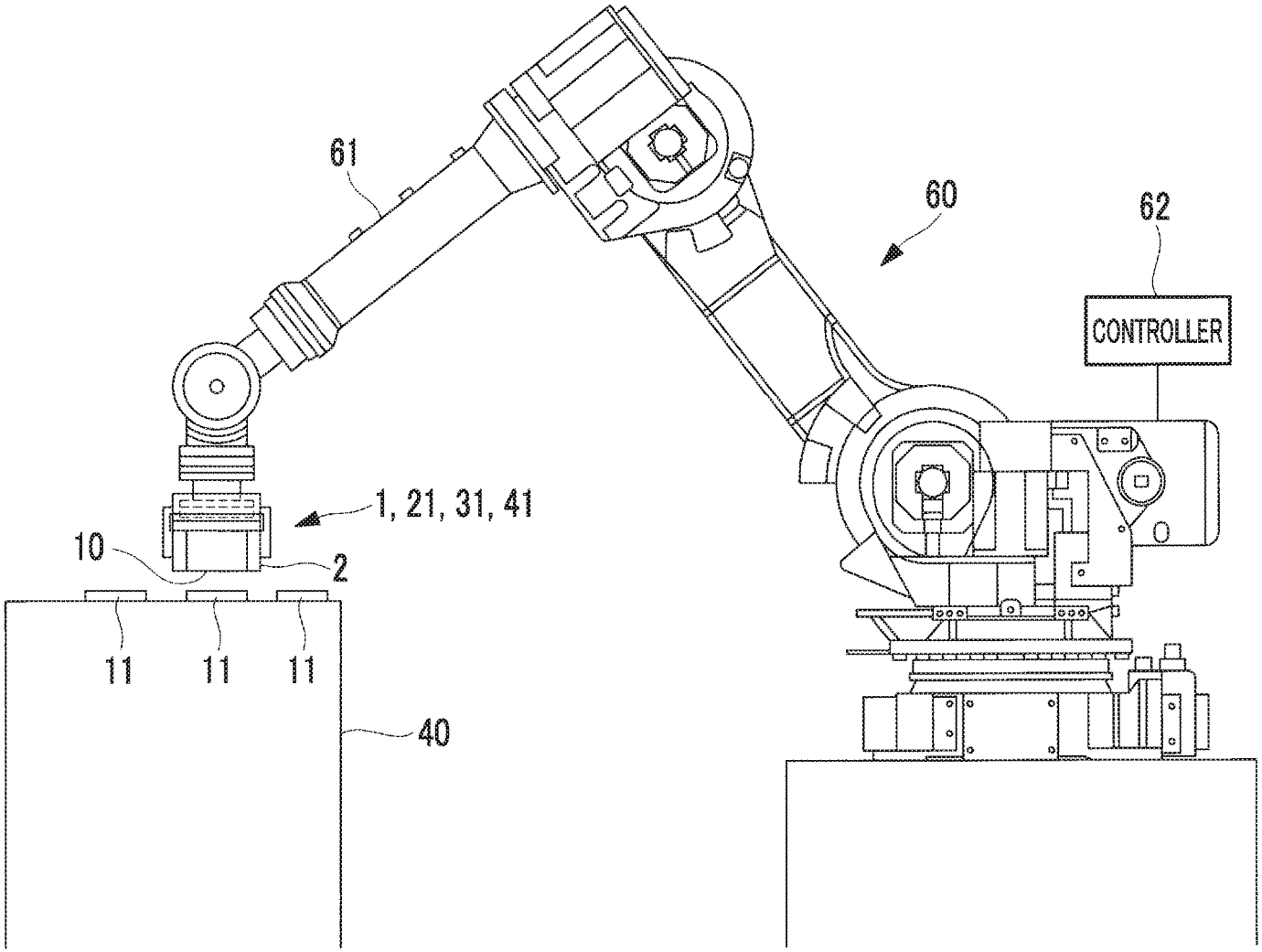
FIG. 17 is a front view showing a coating device and a robot according to an embodiment of the present invention.

For example, as shown in FIG. 17, the coating device 1 is attached to an arm 61 of a robot 60, is moved in one direction while being pressed against the surface of the coating target 11 by the arm 61, and applies the coating agent 10 to the surface of the coating target 11. FIG. 17 shows a case where the coating device 1 is moved in a direction perpendicular to a paper surface of the drawing. The coating agent 10 is always supplied from a tank 3 to the roller 2 when the roller 2 is rotated.

Means for automating the coating operation by the coating device 1 having the roller 2 is not limited to the robot, and it is possible to use a device other than the robot capable of performing a position control or a coating control of the coating device 1. As shown in FIG. 1, the coating device 1 includes the roller 2 which is rotated around a shaft, the tank 3 in which the coating agent 10 is stored, In the coating device 1, the surface of the coating target 11 is moved in one direction, and thus, the roller 2 is rotated in the one direction. In the present embodiment, in a state where the movement direction of the coating device 1 is not limited to two reciprocating directions and is limited to one direction, the coating operation is performed by the coating device 1. In the present embodiment, by limiting the movement direction of the coating device 1 to one direction, the rotation direction of the roller 2 is regulated in only one direction. In order to limit the rotation direction of the roller 2 to only one direction such that the roller 2 can be rotated in one direction, not only the moving direction of the coating device 1 is limited, but also means for regulating the rotation direction by a mechanical configuration such that the roller 2 is not rotated in the opposite direction may be provided in the coating device 1. For example, the regulating means is a one-way clutch, a ratchet mechanism.

For example, the tank 3 is an example of a supply system, is provided in the vicinity of a vertically uppermost member of the roller 2, and supplies the coating agent 10 stored inside the tank 3 to the roller 2. In the tank 3, an opening 8 is formed, and the coating agent 10 is supplied to the roller 2 via the opening 8. In the tank 3, a wall member 4 is provided on a rotation exit side of the roller 2 and a wall member 5 is provided on a rotation entry side of the roller 2 so as to be parallel in an axial direction of the roller 2.

A gap is formed between the wall member 4 on the rotation exit side of the roller 2 and the roller 2, and when the roller 2 is rotated, the coating agent 10 is supplied from the gap. Meanwhile, a gap is formed between the wall member 5 on the rotation entry side of the roller 2 and the roller 2, and when the roller 2 is rotated, an excess coating agent 10 which is not applied to the coating target 11 is returned from the gap.

Plate-shaped doctor blades 6 and 7 are respectively installed on the wall members 4 and 5 in the axial direction of the roller 2, and gaps between the doctor blades 6 and 7 and the roller 2 can be adjusted. The gap formed between the doctor blade 6 on the rotation exit side and the roller is adjusted according to a target coating thickness. According to the adjustment, by using the doctor blade 6, it is possible to prevent the excess coating agent 10 from being supplied.

The gap formed between the doctor blade 7 on the rotation entry side and the roller 2 is larger than the gap formed between the doctor blade 6 on the rotation exit side and the roller 2. In the present embodiment, the rotation direction of the roller 2 is limited to one direction, and thus, the rotation exit side and the rotation entry side are determined, and the respective functions can be divided. The rotation exit side and the rotation entry side are determined, and thus, the gap between the doctor blade 7 on the rotation entry side and the roller 2 can be set to be larger than the gap between the doctor blade 6 on the rotation exit side and the roller 2. As a result, the excess coating agent 10 which is not transferred to the coating target 11 can be returned to the tank 3, and it is possible to prevent the coating agent 10 from being accumulated in an outer side of the roller 2. In FIG. 1, the coating agent 10 which is not transferred to the coating target 11 and is returned to the tank is indicated by a reference numeral 10-*a*, and the coating agent 10 which is transferred to the coating target 11 is indicated by a reference numeral 10-*b*. The gap formed between the doctor blade 7 on the rotation entry side and the roller 2 can be widely set to a limit within which the coating agent 10 does not naturally flow due to the viscosity and the gravity of the coating agent 10.

According to the present embodiment, it is possible to prevent the coating agent from being accumulated in an outer side, which does not relate to the coating of the roller 2, such as outer sides of the doctor blades 6 and 7.

In the above-described present embodiment, the case is shown and described in which an intermediate portion of the tank 3 in a traveling direction of the roller 2 coincides with the uppermost portion of the roller 2 and installation heights of the doctor blades 6 and 7 are approximately the same as each other. However, the present invention is not limited to this.

Figure 2:
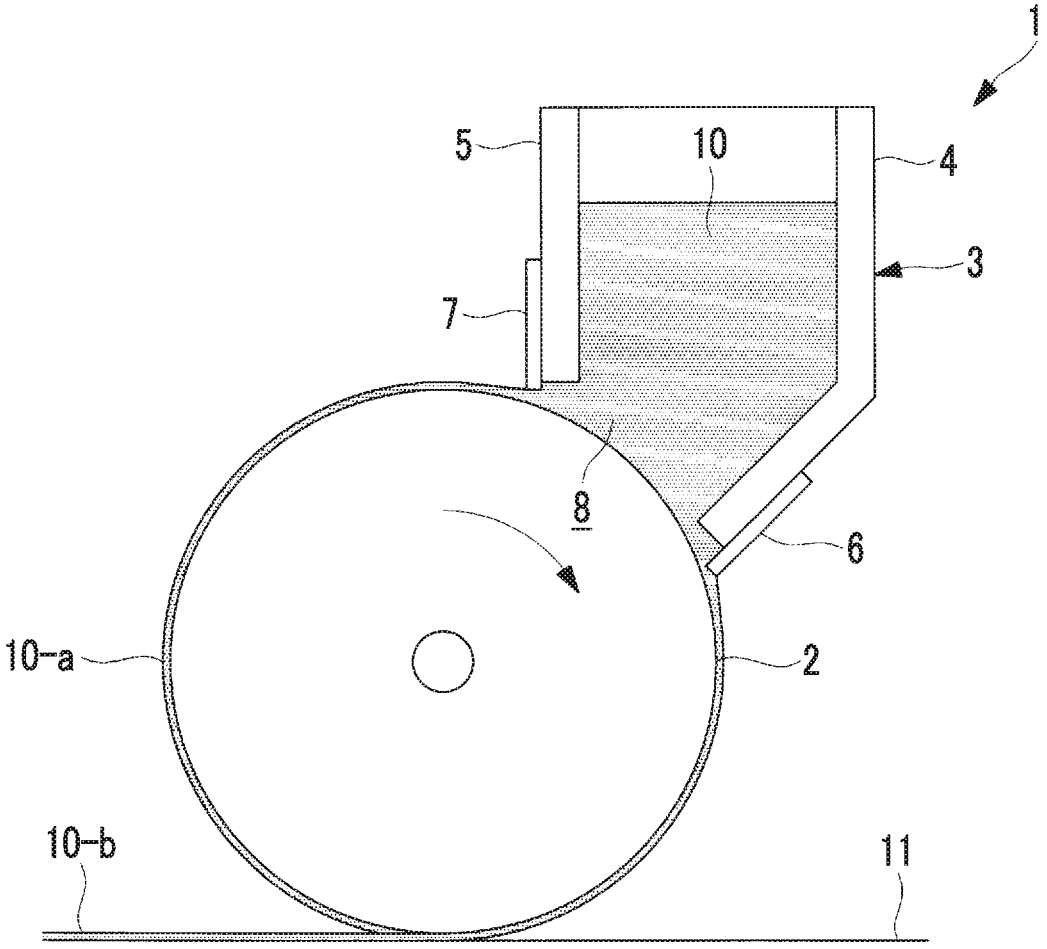
FIG. 2 is a longitudinal sectional view showing a first modification example of the coating device according to the first embodiment of the present invention.

For example, as shown in FIG. 2, tank 3 is provided to be biased toward a front side in the traveling direction of the roller 2, the doctor blade 7 is provided on a front side in the traveling direction of the roller 2 from the vertically uppermost member of the roller 2, and the doctor blade 7 is installed at a position higher than that of the doctor blade 6. In this case, the gap formed between the doctor blade 7 on the rotation entry side and the roller 2 is larger than the gap formed between the doctor blade 6 on the rotation exit side and the roller 2. According to this disposition, the doctor blade 7 on the rotation entry side is disposed over the vertically uppermost member of the roller 2 in the rotation direction of the roller 2, and thus, an outflow limitation of the coating agent 10 which tries to flow out from the gap between the doctor blade 7 and the roller 2 further increases. As a result, the coating agent 10 does not easily flow out from the gap, and it is possible to more stably return the excess coating agent 10 to the tank 3.

Figure 3:
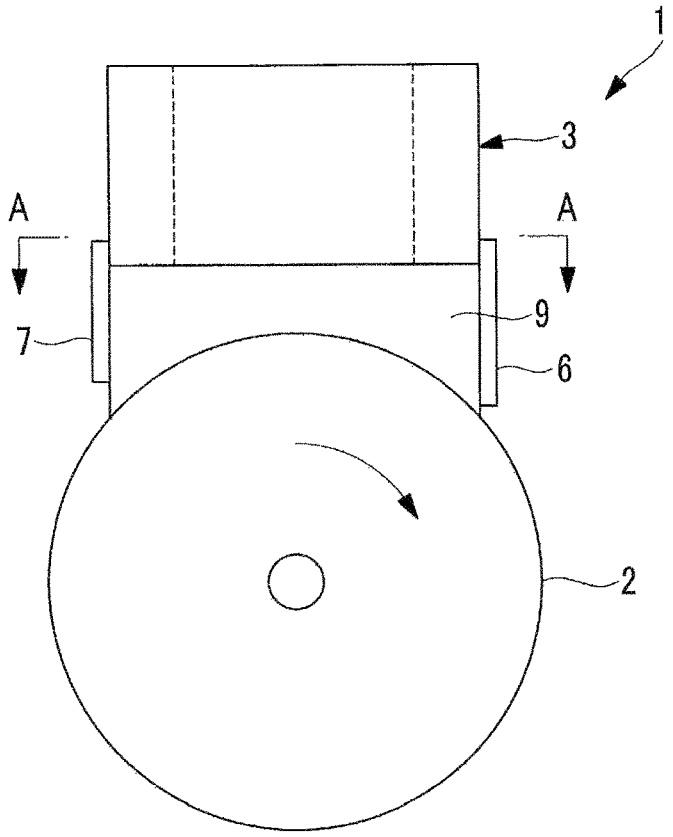
FIG. 3 is a side view showing a second modification example of the coating device according to the first embodiment of the present invention.
Figure 4:
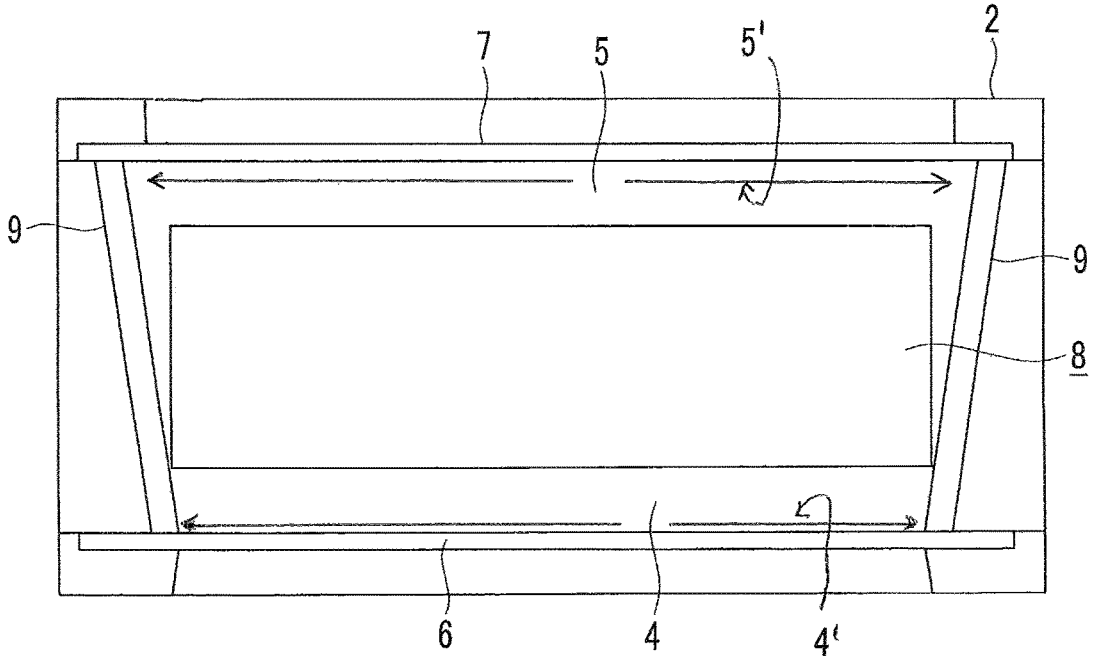
FIG. 4 is a cross sectional view taken along line A-A of FIG. 3.

As shown in FIGS. 3 and 4, in the coating device 1 according to the present embodiment, in the tank 3, shielding materials 9 may be provided on both end portions in the axial direction of the roller 2. For example, each of the shielding materials 9 is a thin plate material formed of a synthetic resin, and a friction force which is generated in a contact member between the shielding material 9 and the roller 2 is small.

The shielding material 9 has an arc shape in the circumferential direction of the roller 2, and prevents the coating agent 10 stored inside the tank 3 from leaking to the outside. As shown in FIG. 4, each of the shielding materials 9 is not provided to be perpendicular to the axial direction of the roller 2 and is obliquely provided in the axial direction, and an opening width on the rotation entry side of the roller 2 formed between the two shielding materials 9 is wider than an opening width on the rotation exit side of the roller 2 formed between the two shielding materials 9.

In the present embodiment, the rotation direction of the roller 2 is limited to one direction, and thus, according to the above-described configuration, the excess coating agent 10 is reliably and easily returned into the tank 3 by the shielding materials 9 on the rotation entry side of the roller 2 in the tank 3. As a result, the coating agent 10 is not easily accumulated in the vicinity of both end portions in the axial direction of the roller 2 on the rotation entry side of the roller 2.

Figure 5:
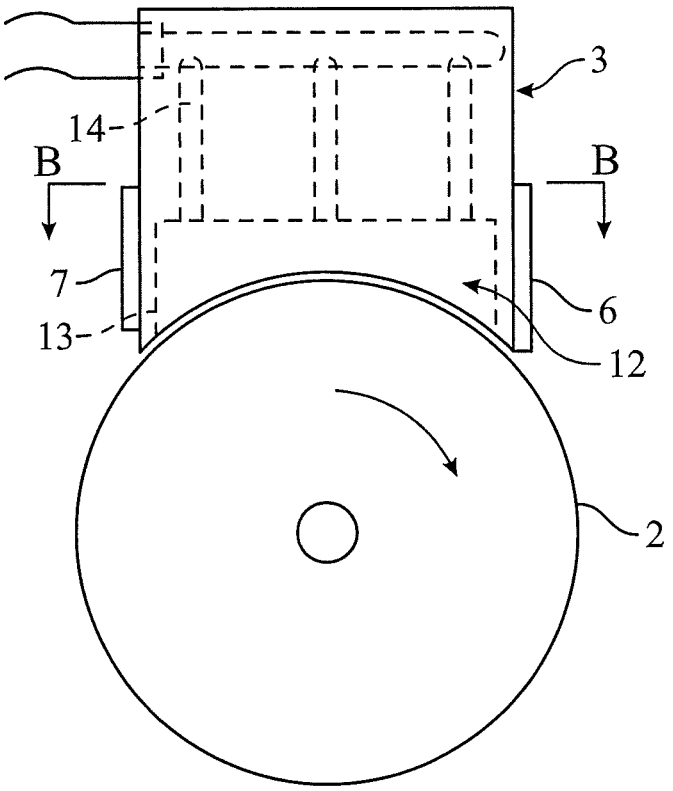
FIG. 5 is a side view showing a third modification example of the coating device according to the first embodiment of the present invention.
Figure 6:
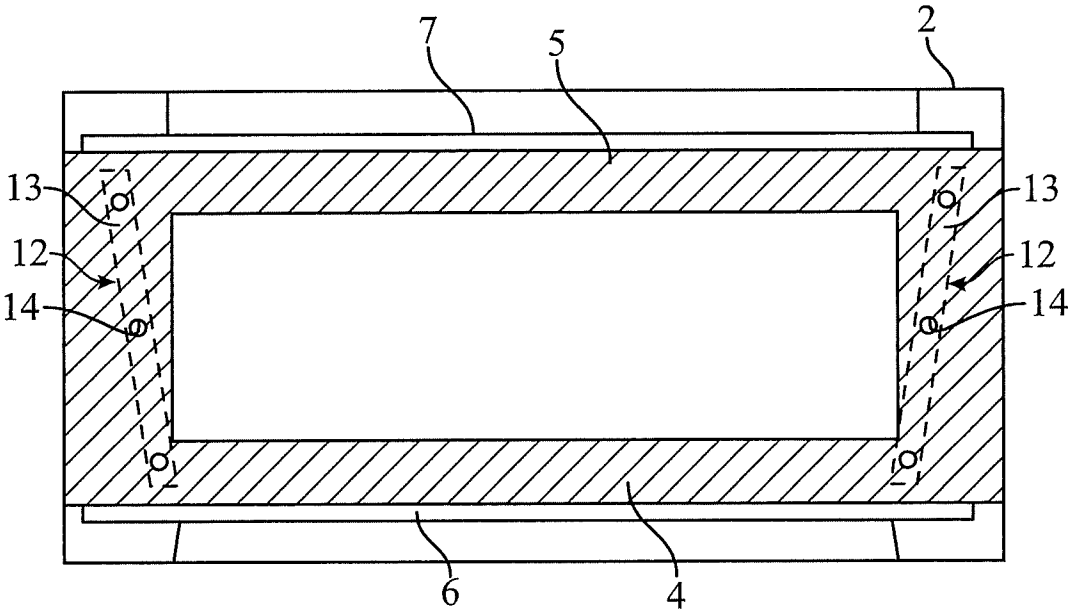
FIG. 6 is a cross sectional view taken along line B-B of FIG. 5.

In the above-described embodiment, the case is described in which the shielding materials 9 which are in contact with the roller 2 are provided on the both end portions in the axial direction of the roller 2. However, the present invention is not limited to this. That is, as shown in FIGS. 5 and 6, non-contact type shields 12 may be provided on both end portions in the axial direction of the roller 2. For example, the shields 12 prevent the coating agent 10 from leaking to the outside using an air pressure. For example, each of the shields 12 includes an opening 13 through which air is blown toward the roller 2, air supply paths 14 through which the air is supplied to the opening 13. The opening 13 is provided in the circumferential direction of the roller 2. Compressed air is supplied to the air supply paths 14 from the outside, and the air is blown from the openings 13 toward the roller 2 via the air supply paths 14. By the blowing of the air, it is possible to prevent the coating agent 10 from leaking to the outside without increasing the rotational friction of the roller 2.

Similarly to the shielding materials 9, each of the shield 12 is obliquely provided in the axial direction of the roller 2, and an opening width on the rotation entry side of the roller 2 formed between the two shields 12 is wider than an opening width on the rotation exit side of the roller 2 formed between the two shields 12. According to this configuration, the excess coating agent 10 is reliably and easily returned into the tank 3 by the shield 12 on the rotation entry side of the roller 2 in the tank 3. As a result, the coating agent 10 is not easily accumulated in the vicinity of both end portions in the axial direction of the roller 2 on the rotation entry side of the roller 2.

In the above-described first embodiment, the shielding materials 9 or the shields 12, which are not provided to be perpendicular to the axial direction of the roller 2 but are obliquely provided in the axial direction, may not necessarily be provided, and the two shielding materials 9 or the two shields 12 may be installed to be parallel to each other.

Second Embodiment

Next, a coating device according to a second embodiment of the present invention will be described.

Figure 7:
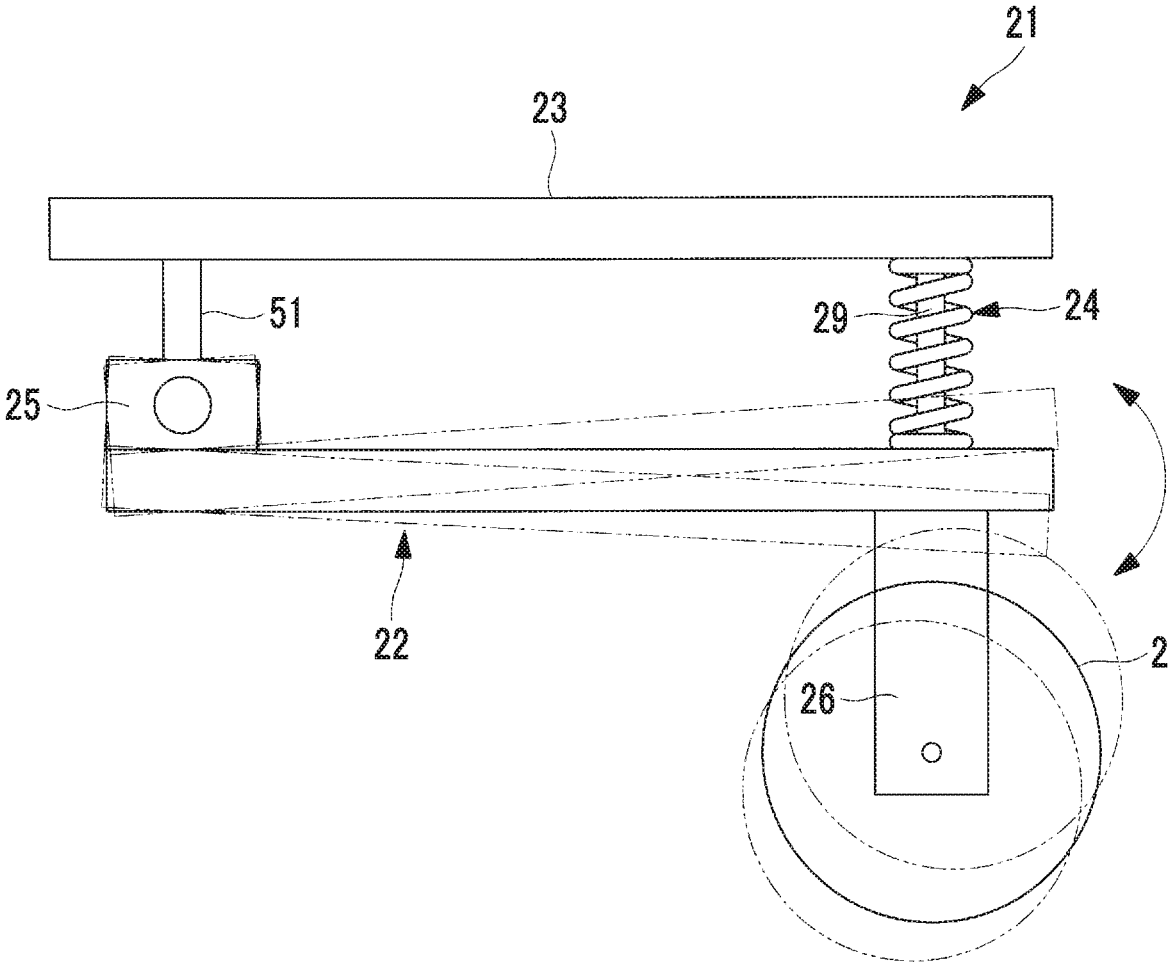
FIG. 7 is a side view showing a coating device according to a second embodiment of the present invention.
Figure 8:
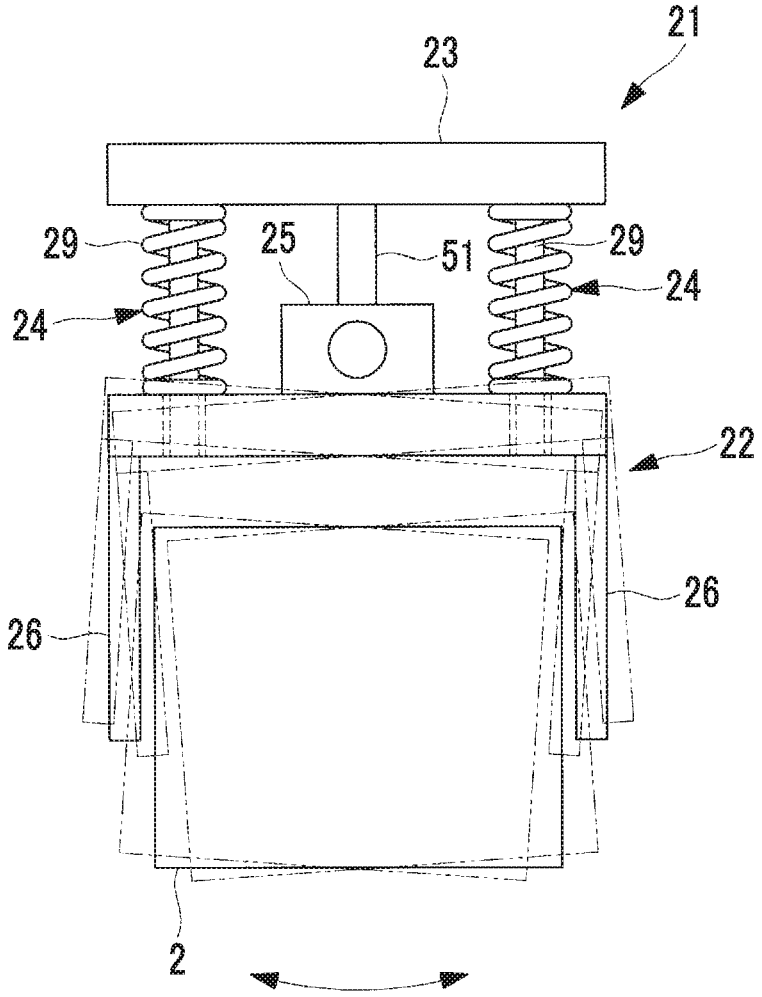
FIG. 8 is a front view showing a coating device according to a second embodiment of the present invention.

As shown in FIGS. 7 and 8, in a coating device 21 according to the present embodiment, the roller 2 can be tilted in a pitch direction and a roll direction, and even in a case where the coating target 11 has an inclined surface or a threaded surface, it is possible to smoothly perform the application of the coating agent 10.

The coating device 21 includes the roller 2 which is rotatable around a shaft and a tank (not shown) in which the coating agent 10 is stored.

The coating device 21 includes a support 22 which supports the roller 2, a base 23, a spring 24, and a spherical bearing 25

For example, the support 22 is a plate-shaped member which is long in the traveling direction of the roller 2, the roller 2 is supported by a lower surface side of the support 22, and an upper surface side of the support 22 is connected to the base 23 via the spring 24 and the spherical bearing 25. Two end plates 26 are installed on the lower surface side of the support 22, and the end plates 26 are connected to end portions of the shaft of the roller 2. Accordingly, the roller 2 is rotatably supported by the end plates 26.

The spring 24 includes a compression spring and is provided above the roller 2 in a state where the support 22 is interposed therebetween. A lower end of the spring 24 is connected to the support 22 and an upper end of the spring 24 is connected to the base 23. Two springs 24 are installed on a straight line parallel to the shaft of the roller 2. A rod 29 passes through a center of each spring 24 such that the compression spring reliably expands and contracts in a vertical direction.

The spherical bearing 25 passes through the center in the axial direction of the roller 2, and is installed on a straight line parallel in the traveling direction of the roller 2. An outer ring of the spherical bearing 25 is installed on an upper surface of the support 22 and a rod 51 which is connected to an inner ring of the spherical bearing 25 is connected to the base 23. The spherical bearing 25 is installed behind the roller 2 in the traveling direction of the roller 2. The roller 2 and the spherical bearing 25 are separated from each other, and thus, a vertically oscillating width of the roller 2 can increase.

According to the above-described configuration, the roller 2 can move in the vertical direction with respect to the base 23, and the axial direction of the roller 2 can be tilted with respect to the base 23. When the coating device 21 is pressed to the coating target 11, the roller 2 is always pressed to the surface of the coating target 11 by the springs 24.

In this way, while the coating operation is performed, the roller 2 can be tilted in the pitch direction and the roll direction with respect to the traveling direction of the roller 2 while the roller 2 is pressed to the surface of the coating target 11, and thus, even in the case where the coating target 11 has an inclined surface or a threaded surface, it is possible to smoothly perform the application of the coating agent 10. As a result, in a case where the coating operation is automatized, it is not necessary to set a route through which the roller passes, taking into account an inclination of the coating target. That is, in a case of aircraft parts, that is, even in a case where coating is applied to various kinds of parts having slightly different inclinations, it is not necessary to finely set a route for automatization for each part, and thus, the automatization of the coating operation is easily performed.

In the above-described embodiment, in the coating device 21, the case in which the spherical bearing 25 is used is described. However, the present invention is not limited to this example.

Figure 9:
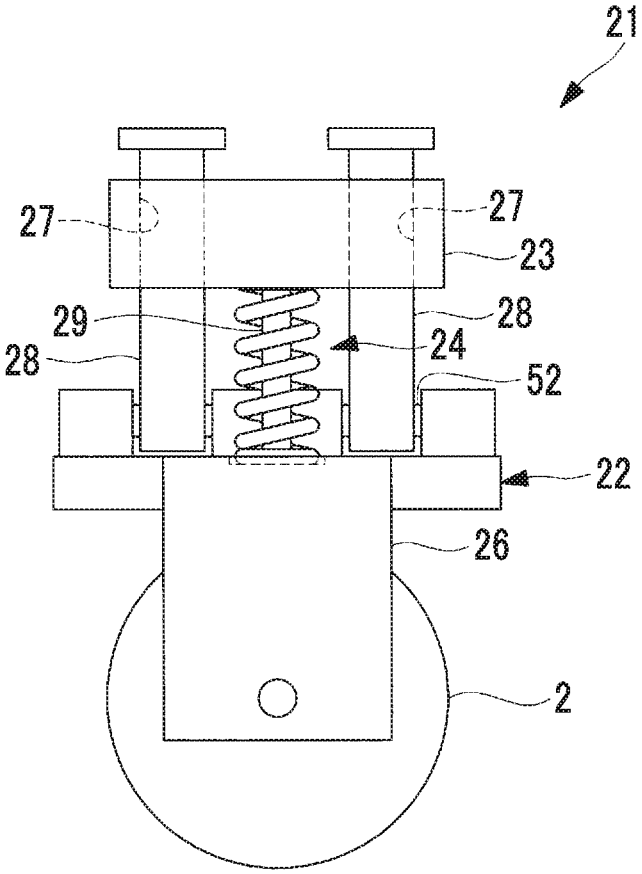
FIG. 9 is a side view showing a modification example of the coating device according to the second embodiment of the present invention.
Figure 10:
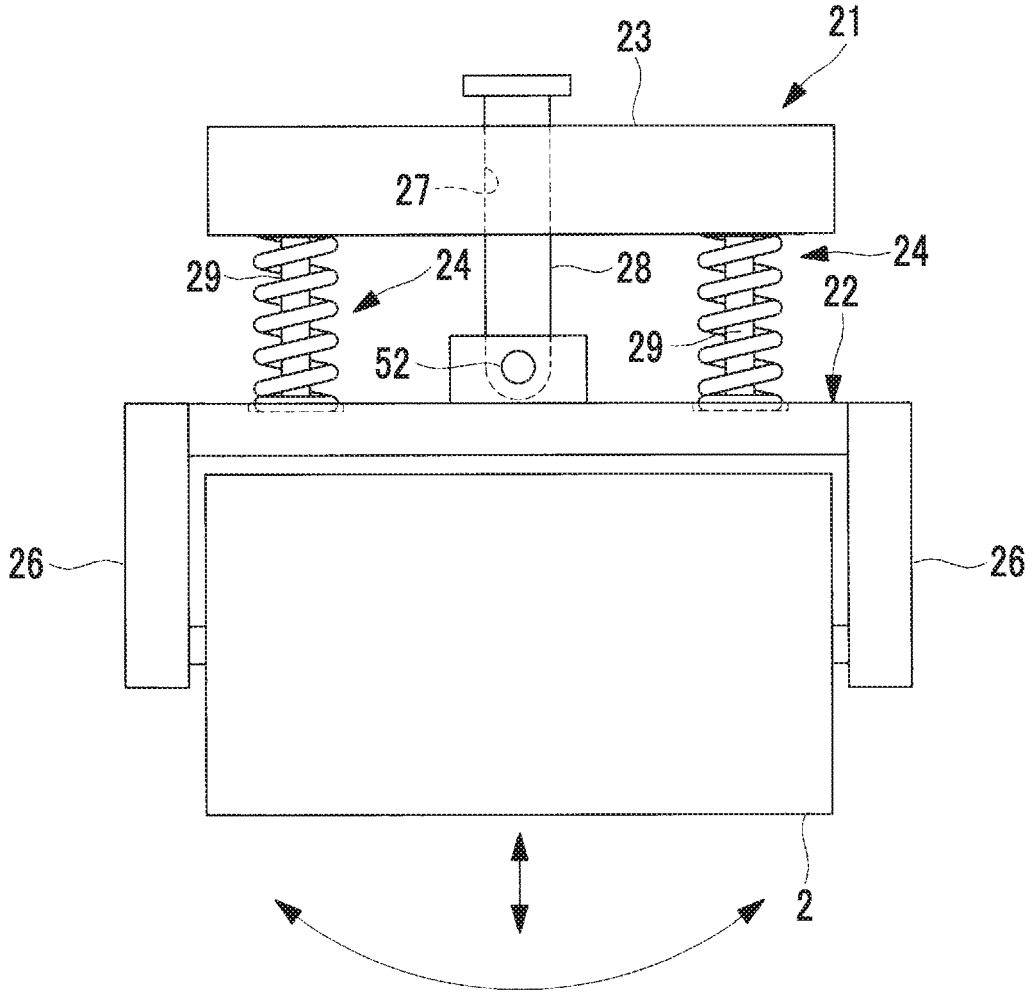
FIG. 10 is a front view showing a modification example of the coating device according to the second embodiment of the present invention.

For example, as shown in FIGS. 9 and 10, in the coating device 21, through-holes 27 formed in the vertical direction are provided in the base 23, and a guide pin 28 is provided to pass through each of the through-holes 27. A lower end of the guide pin 28 is connected to the upper surface of the support 22. The through-holes 27 and the guide pins 28 are provided at the center in the axial direction of the roller 2, and are provided at two locations in the traveling direction of the roller 2. The guide pins 28 and the support 22 can be rotated about a shaft 52 parallel in the traveling direction of the roller 2.

In the present modification example, similarly to the above-described embodiment, the springs 24 include compression springs and are installed above the roller 2 in a state where the support 22 is interposed therebetween. A lower end of each spring 24 is connected to the support 22 and an upper end of each spring 24 is connected to the base 23. Two springs 24 are installed on a straight line parallel to the shaft of the roller 2. A rod 29 passes through a center of each spring 24 such that the compression spring reliably expands and contracts in a vertical direction.

According to the above-described configuration, the roller 2 can move in the vertical direction with respect to the base 23, and the axial direction of the roller 2 can be tilted with respect to the base 23. When the coating device 21 is pressed to the coating target 11, the roller 2 is always pressed to the surface of the coating target 11 by the springs 24.

Third Embodiment

Next, a coating device according to a third embodiment of the present invention will be described.

Figure 11:
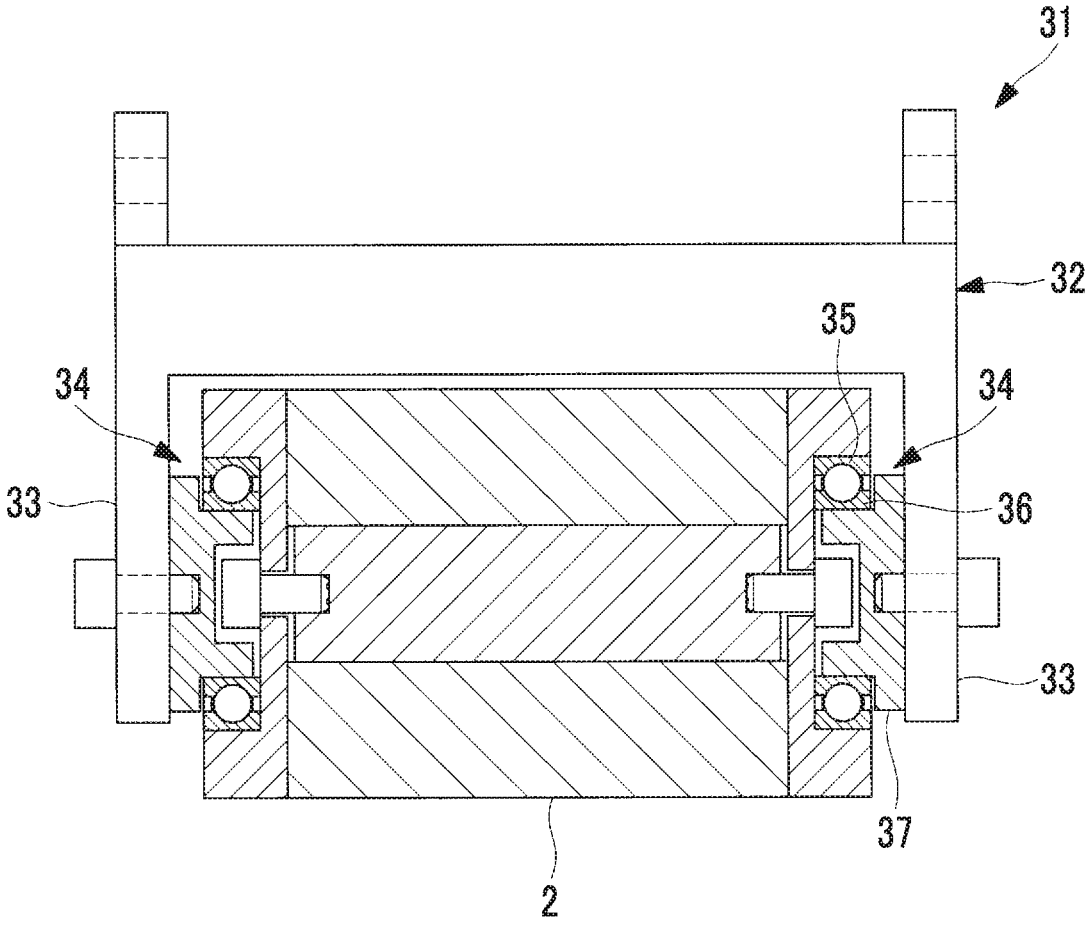
FIG. 11 is a longitudinal sectional view showing a coating device according to a third embodiment of the present invention.

As shown in FIG. 11, a coating device 31 according to the present embodiment has a configuration which positively generates a synchronous rotation of the roller 2, and thus, it is possible to stably apply the coating agent 10. That is, the coating device 31 according to the present embodiment has a configuration in which a resistance generated between a support shaft of the roller 2 and a support bearing for supplying of the support shaft when the roller 2 is rotated becomes smaller than a resistance generated between the roller 2 and the application surface.

The coating device 31 includes the roller 2 which is rotatable around the shaft and a tank (not shown) in which the coating agent 10 is stored.

As shown in FIG. 11, the coating device 31 includes a support 32 which supports the roller 2, and two end plates 33 are installed on a lower surface side of the support 32. The end plates 33 are connected to the end portions of the shaft of the roller 2 via bearings 34. Accordingly, the roller 2 is rotatably supported by the bearings 34.

Each of the bearings 34 includes an outer ring 35 and an inner ring 36, the outer ring 35 is connected to the end portion of the roller 2, and the inner ring 36 is connected to a connection member 37 provided on the end plate 33. One side of the connection member 37 is connected to the end plate 33, and the other side thereof is inserted into an inner periphery of the inner ring 36 of the bearing 34 so as to be connected thereto.

The bearings 34 are used, and thus, unlike a case where the rotation support of the roller 2 is performed by a through rod installed to pass through the axis of the roller 2, when the coating agent 10 is applied, the rotation of the roller 2 is not easily stopped, and the roller 2 does not easily generate the stick slip. As a result, the roller 2 can be synchronously rotated with respect to the relative feed, and the coating agent 10 can be uniformly applied to the surface of the coating target 11.

Figure 12:
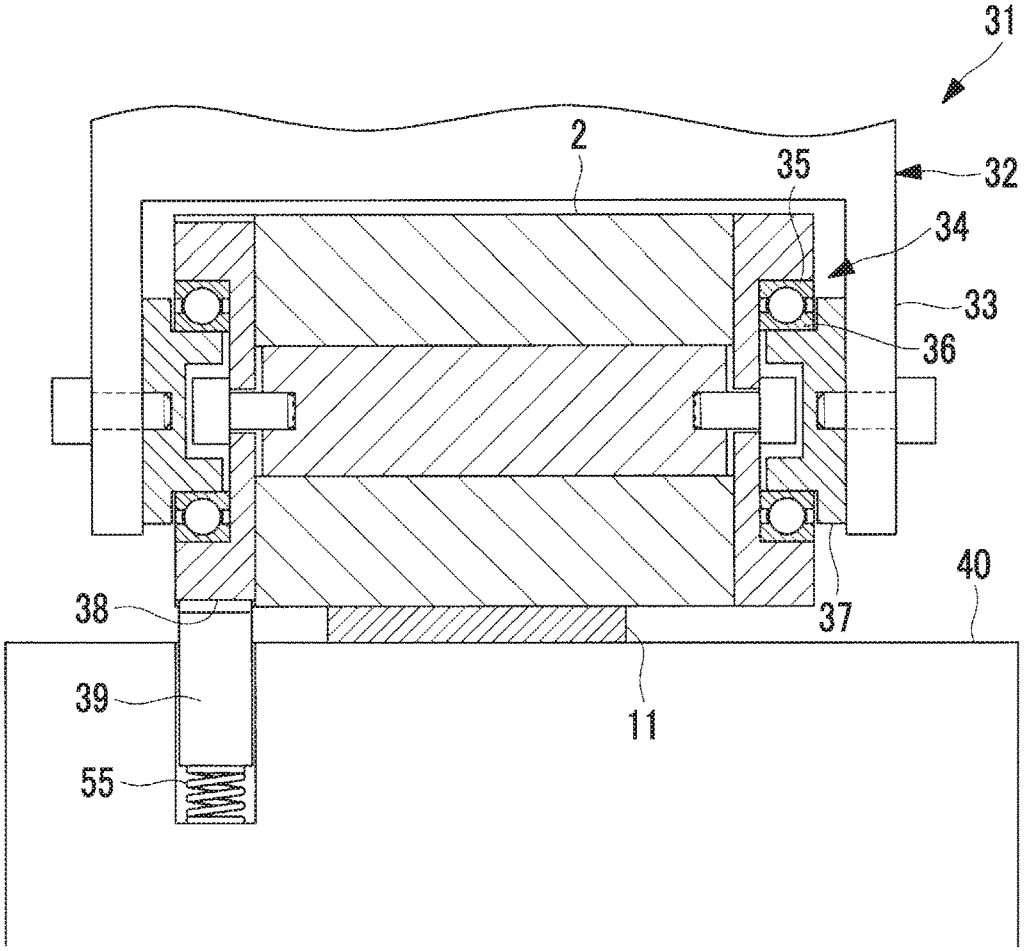
FIG. 12 is a longitudinal sectional view showing a first modification example of the coating device according to the third embodiment of the present invention.
Figure 13:
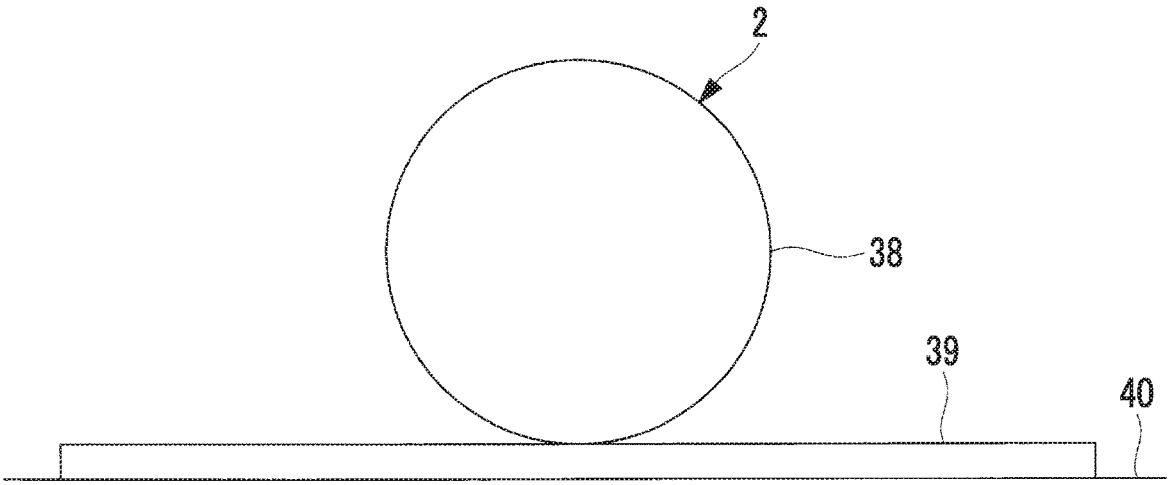
FIG. 13 is a side view showing the first modification example of the coating device according to the third embodiment of the present invention.

As shown in FIGS. 12 and 13, meshing teeth 38 may be provided in a circumferential direction of the roller 2 on one end side in the axial direction of the roller 2, and liner meshing teeth 39 which mesh with the meshing teeth 38 are provided to be parallel in the traveling direction of the coating device 31. The meshing teeth 39 are installed on a work table 40 on which the coating target 11 is installed. The meshing teeth 39 are an example of a first friction member and the meshing teeth 38 are an example of the second friction member.

Accordingly, during the application of the coating agent 10, when the roller 2 advances in the traveling direction, the meshing teeth 38 installed on the roller 2 mesh with the meshing teeth 39 installed on the work table 40, and thus, the roller 2 is reliably rotated. That is, by forcibly synchronizing the movement of the roller 2 in one direction and the rotation of the roller 2, the roller 2 can be synchronously rotated with respect to the relative feed, and the coating agent 10 can be uniformly applied to the surface of the coating target 11.

A member which is provided in the circumferential direction of the roller 2 and the work table 40 and forcibly synchronize the movement of the roller 2 in the one direction and the rotation of the roller 2 is not limited to the meshing teeth 38 and 39. For example, instead of the meshing teeth 38 and 39, a high friction member (for example, a sandpaper) having high friction surface properties may be provided in the circumferential direction of the roller 2 and the work table 40.

As shown in FIG. 12, an elastic member 55 may be provided a lower surface of the above-described meshing teeth 39 or the high friction member (sandpaper) provided on the surface of the work table 40. For example, the elastic member 55 is a compression spring, supports the meshing teeth 39 or the high friction member from below, and generates a pressing force in the meshing teeth 39 or the high friction member. Even in a case where an inclination or twist exists on the surface of the coating target 11 due to the elastic member 55, even if mutual positions (or mutual positions of the meshing teeth 38 and the high friction member) of the meshing teeth 38 and 39 or the circumferential direction of the roller 2 are changed, it is possible to maintain mutual positional relationships and synchronously rotate the roller 2 reliably.

Figure 14:
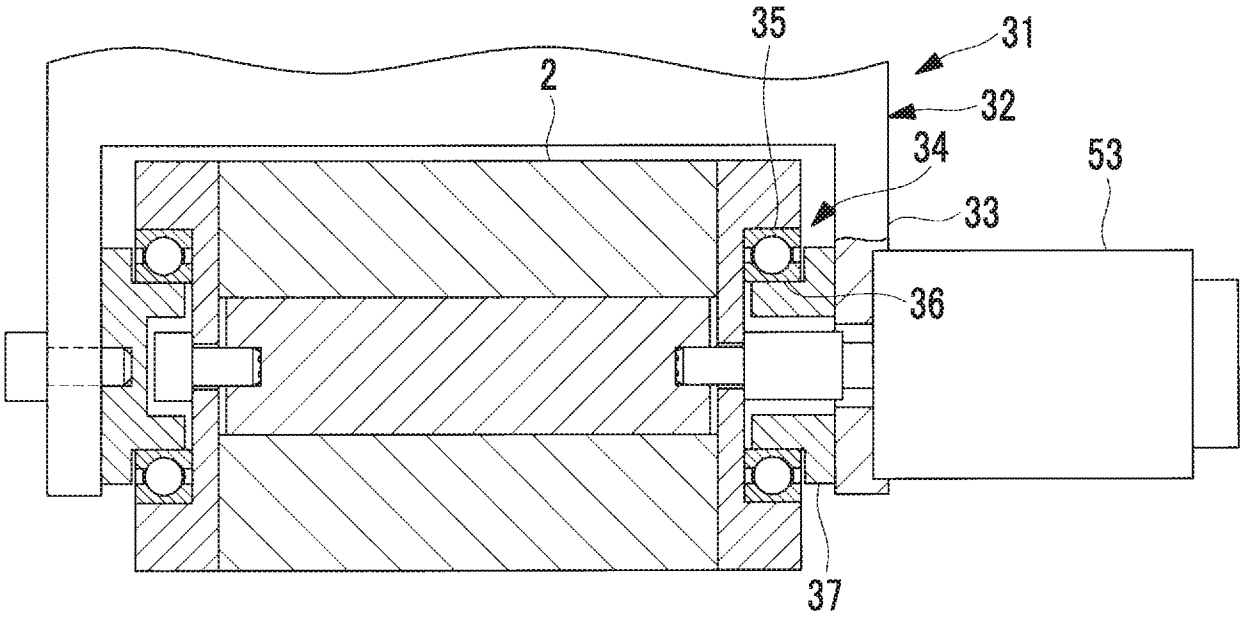
FIG. 14 is a longitudinal sectional view showing a second modification example of the coating device according to the third embodiment of the present invention.

In addition, in the above-described embodiment, when the application of the roller 2 is performed, the case where the roller 2 is passively rotated by the friction force between the roller 2 and the coating agent 10 and the case where the roller 2 is passively rotated by the meshing teeth 38 attached to the roller 2 and the meshing teeth 39 or the high friction member are described. However, as shown in FIG. 14, the roller 2 may be positively rotated by a drive force of a servo motor 53. The servo motor 53 is connected to the roller 2 and rotates the roller 2 synchronously with a speed in the traveling direction of the roller 2. As shown in FIG. 17, in a case where the roller 2 is moved in one direction by the arm 61 of the robot 60, a controller 62 of the robot 60 and the servo motor 53 transmit and receive signals, and the servo motor 53 rotates the roller 2 at the rotation speed of the roller 2 based on the speed in the traveling direction of the roller 2. For example, the speed in the traveling direction of the roller 2 may be acquired based on an arm speed control value of the robot 60 or may be acquired based on a position detection sensor installed in the arm 61 or the roller 2.

Accordingly, it is possible to rotate the roller 2 at a predetermined speed synchronously with the speed in the traveling direction of the roller 2, and the coating agent 10 can be uniformly applied to the surface of the coating target 11.

The present embodiment is not limited to the case where the roller 2 is moved in one direction by the arm 61 of the robot 60 and can be applied to a case where the position of the roller 2 is fixed and the working table on which the coating target 11 is placed is moved. That is, a controller of the work table and the servo motor 53 transmit and receive signals, and the servo motor 53 rotates the roller 2 at the rotation speed of the roller 2 based on a relative speed between the roller 2 and the work table.

In the above description, in the coating device 31, with respect to the roller 2, the configuration in which the bearing 34 is provided, the configuration in which the meshing teeth 38 and 39 are provided, and the configuration in which the servo motor 53 is provided are described separately. However, all configurations may be combined with each other, or one or two of the configurations may be selected.

Fourth Embodiment

Next, a coating device according to a fourth embodiment of the present invention will be described.

Figure 15:
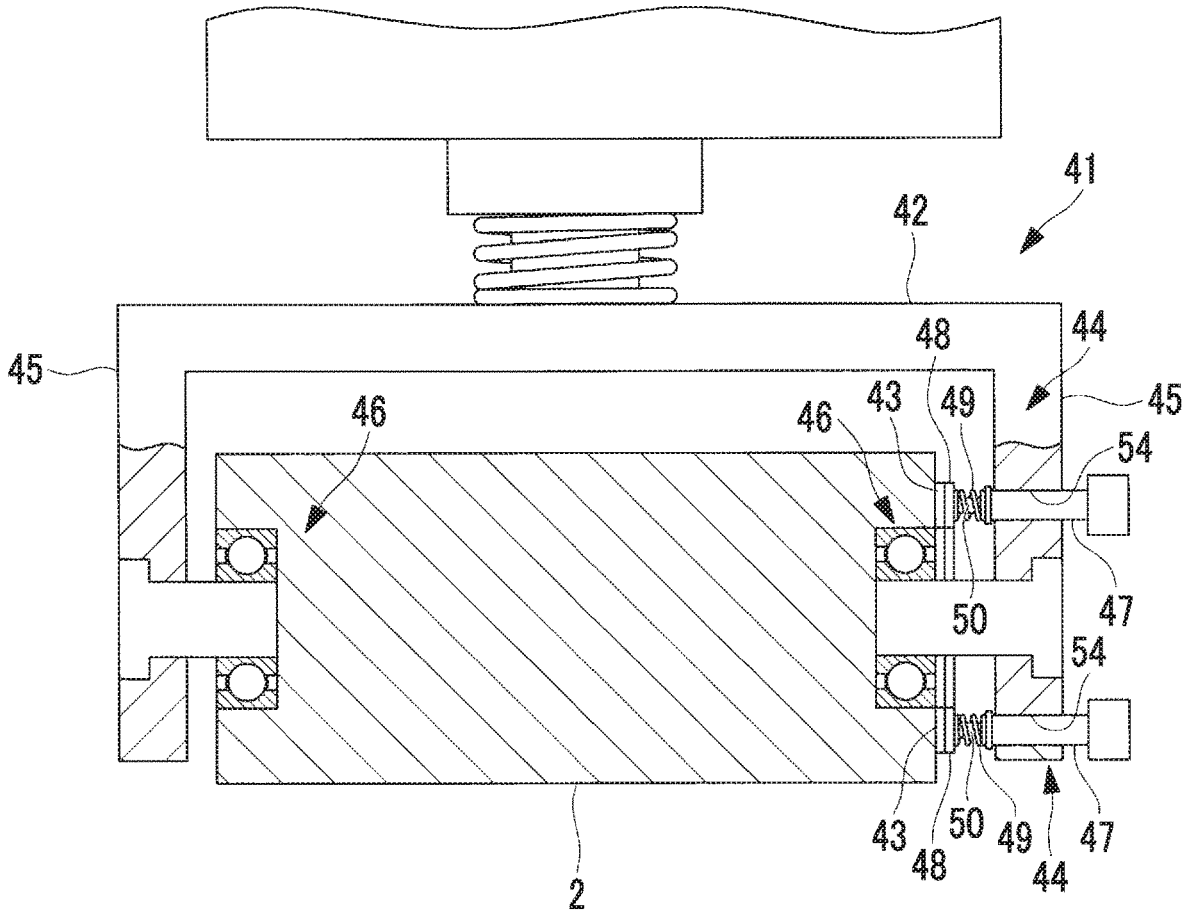
FIG. 15 is a longitudinal sectional view showing a coating device according to a fourth embodiment of the present invention.

As shown in FIG. 15, in a coating device 41 according to the present embodiment, a rotation friction can be applied to the roller 2, and it is possible to prevent the coating agent 10 from being applied more than a necessary thickness.

The coating device 41 includes the roller 2 which is rotatable around the shaft and a tank (not shown) in which the coating agent 10 is stored.

The coating device 41 includes a support 42 which supports the roller 2, a friction plate 43 which is provided on an end surface of the roller 2, adjustment units 44 which come into contact with the friction plate 43

Two end plates 45 are installed on a lower surface side of the support 42. Each of the end plates 45 is connected to the end portion of the shaft of the roller 2 via a bearing 46. Accordingly, the roller 2 is rotatably supported by the bearings 46.

The friction plate 43 is an annular plate-shaped member and is provided on one end surface positioned on an axial end portion of the roller 2.

Each of the adjustment units 44 includes a screw portion 47, a contact member 48, a compression spring 49. The screw portion 47 is installed to be screwed to a screw hole 54 formed in the end plate 45 and a position of the screw portion 47 is changed in the axial direction. The contact member 48 is a plate-shaped member which comes into contact with the friction plate 43 on one surface side, and the other surface side of the contact member 48 is connected to the compression spring 49. A through rod 50 which passes through the center of the compression spring 49 may be provided in the contact member 48. The compression spring 49 can be reliably expanded and contracted in the axial direction by the through rod 50. On end portion of the compression spring 49 is connected to an end portion of the screw portion 47, and the other end portion thereof is connected to the contact member 48.

Each of the contact members 48 is always pressed to the friction plate 43 of the roller 2 by an elastic force of the compression spring 49. The axial position of the adjustment unit 44 can be adjusted, and thus, a distance between the adjustment unit 44 and the contact member 48 is changed. Accordingly, the elastic force generated by the compression spring 49 is changed, and a force for pressing the contact member 48 to the friction plate 43 is changed. As a result, a rotational friction force generated in the roller 2 is adjusted.

Figure 16:
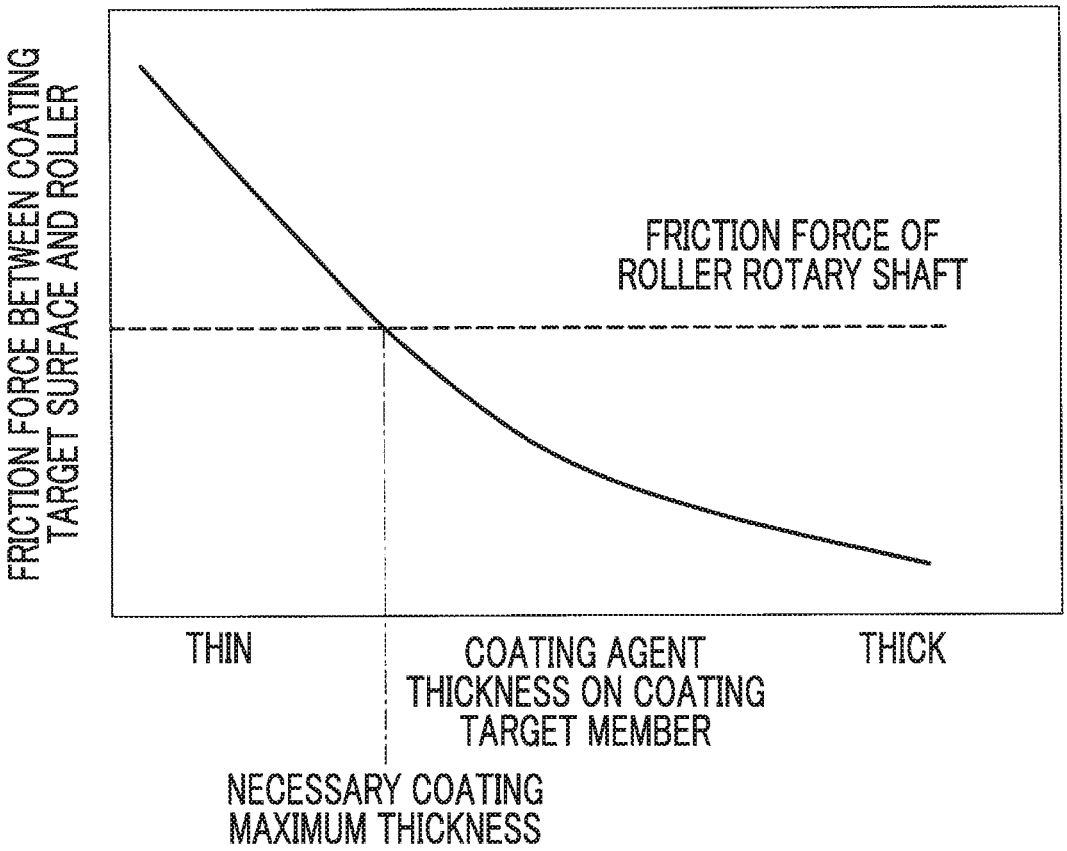
FIG. 16 is a graph showing a relationship between a friction force between an application target surface and a roller, and a coating agent thickness on a coating target.

For example, the rotational friction force generated in the roller 2, that is, the friction force of the rotary shaft of the roller 2 is determined based on a graph shown in FIG. 16. FIG. 16 is a graph showing a relationship between the friction force generated between the application target surface and the roller 2, and a thickness of the coating agent 10.

The roller 2 applies the coating agent 10, several times, to the coating agent 10 applied to the coating target 11, that is, over-coating is performed, and thus, the thickness of the coating agent 10 increases. In a case where a sealing material is applied to the aircraft part, the over-coating is performed before the last applied sealing material is completely dried. In this case, as the thickness of the coating agent 10 increases (that is, as the number of over-coating increases), the friction force generated between the application target surface and the roller 2 gradually decreases. If the rotational friction force generated in the roller 2 is larger than the friction force generated between the application target surface and the roller 2, the roller 2 slides on the coating agent 10, the roller 2 is not easily rotated, and as a result, the thickness of the coating agent 10 applied by once application decreases.

A relationship between the axial position of the adjustment unit 44 and the rotational friction force generated in the roller 2 or a relationship between the friction force generated between the application target surface and the roller 2 and the thickness of the coating agent 10 are acquired by experiment in advance.

In the present embodiment, each of the adjustment units 44 adjusts the rotational friction force generated in the roller 2 using the above-described relationships. For example, in a case where the thickness of the coating agent 10 applied by once application is less than a predetermined thickness, the rotational friction force generated in the roller 2 increase to be higher than the friction force generated between the application target surface and the roller 2, and thus, the roller 2 is not easily rotated. As shown in FIG. 16, the thickness of the coating agent 10 applied by the once application can be determined by adjusting the rotational friction force generated in the roller 2 using the adjustment units 44, based on the relationship between the friction force generated between the application target surface and the roller 2 and the thickness of the coating agent 10.

REFERENCE SIGNS LIST

1: coating device 2: roller 3: tank 4: wall member 5: wall member 6: doctor blade 7: doctor blade 8: opening 9: shielding material 10: coating agent 11: coating target 12: shield 13: opening 14: air supply path 21: coating device 22: support 23: base 24: spring 25: spherical bearing 26: end plate 27: through-hole 28: guide pin 29: rod 31: coating device 32: support 33: end plate 34: bearing 35: outer ring 36: inner ring 37: connection member 38: meshing teeth 39: meshing teeth 40: work table 41: coating device 42: support 43: friction plate 44: adjustment unit 45: end plate 46: bearing 47: screw portion 48: contact member 49: compression spring 50: through rod 51: rod 52: shaft 53: servo motor 54: screw hole 55: elastic member 60: robot 61: arm 62: controller

The invention claimed is:

1. A coating device comprising:

a roller which is rotated in one direction;

a supply system which includes an opening formed with respect to the roller and supplies a coating agent to the roller via the opening;

a first doctor blade which is provided at a wall of the supply system on a rotation exit side of the roller; and a second doctor blade which is provided at a wall of the supply system on a rotation entry side of the roller, wherein a gap formed between the second doctor blade and the roller is larger than a gap formed between the first doctor blade and the roller, wherein the second doctor blade is provided on a front side in a traveling direction of the roller and two shields which are provided on opposite end portions of the roller in the axial direction, wherein an opening width in the axial direction between the two shields on a rotation entry side of the roller is wider than an opening width in the axial direction between the two shields on a rotation exit side of the roller.

2. The coating device according to claim 1, further comprising: a support which is provided in the roller and is configured to tilt the roller in at least one of a pitch direction and a roll direction with respect to a relative traveling direction between the roller and a coating target.

3. The coating device according to claim 1, further comprising:

bearing members which are provided on both end sides of the roller and rotatably support the roller.

4. The coating device according to claim 1, further comprising:

a first friction member which is provided in a traveling direction of the roller on a work table side to which the coating agent is supplied; and a second friction member which is provided in a circumferential direction of the roller and comes into contact with the first friction member.

5. The coating device according to claim 1, further comprising:

a rotation drive portion which rotationally drives the roller; and a controller which synchronizes a speed of the roller in a traveling direction and a rotation speed of the roller.

6. The coating device according to claim 1, further comprising:

an adjustment unit which applies a friction force against a rotation of the roller and adjusts the friction force to be applied.

* * * * *